US006573884B1

(12) United States Patent
Kinzie

(10) Patent No.: US 6,573,884 B1
(45) Date of Patent: Jun. 3, 2003

(54) ADA CONVERTIBLE INPUT DISPLAY

(75) Inventor: Robert A. Kinzie, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 4 days.

(21) Appl. No.: 09/626,175

(22) Filed: Jul. 27, 2000

Related U.S. Application Data

(62) Division of application No. 09/174,518, filed on Oct. 16, 1998.

(51) Int. Cl.[7] ..... B67D 5/00

(52) U.S. Cl. ..... 345/156; 345/1.1; 345/1.2; 208/15; 208/16; 222/255; 222/266; 414/392

(58) Field of Search ..... 345/1.1, 1.2; 208/15, 208/16; 222/255, 266; 414/392

(56) References Cited

U.S. PATENT DOCUMENTS

| | | | | | |
|---|---|---|---|---|---|
| 3,651,512 | A | | 3/1972 | Summers | 340/325 |
| 4,199,100 | A | | 4/1980 | Wostl et al. | 235/381 |
| 4,395,627 | A | * | 7/1983 | Barker et al. | 235/381 |
| 4,750,130 | A | * | 6/1988 | Shimamura et al. | 705/413 |
| 5,220,652 | A | | 6/1993 | Rowley | 395/275 |
| 5,383,500 | A | | 1/1995 | Dwars et al. | 141/98 |
| 5,482,139 | A | | 1/1996 | Rivalto | 186/36 |
| 5,610,382 | A | | 3/1997 | Yamamoto | 235/379 |
| 5,734,851 | A | | 3/1998 | Leatherman et al. | 395/329 |
| 5,859,416 | A | * | 1/1999 | Gatto | 235/384 |
| 5,859,419 | A | | 1/1999 | Gatto | 235/384 |
| 5,890,520 | A | | 4/1999 | Johnson, Jr. | 141/94 |
| 5,923,572 | A | | 7/1999 | Pollock | 364/528.17 |
| 6,082,618 | A | * | 7/2000 | Brown | 235/381 |
| 6,087,954 | A | | 7/2000 | McSpadden et al. | 340/825.19 |
| 6,264,103 | B1 | * | 7/2001 | Stanley | 235/381 |

* cited by examiner

*Primary Examiner*—Bipin Shalwala
*Assistant Examiner*—Vincent E. Kovalick
(74) *Attorney, Agent, or Firm*—Withrow & Terranova, PLLC

(57) ABSTRACT

The present invention relates to a fuel dispenser which is located in a fueling environment that includes a convenience store or a quick serve restaurant. The fueling dispenser includes a display providing menu options and input devices for a user to select various goods and services available at the location. The display includes a first display having user selectable options and input devices positioned on the fueling dispenser. The display further includes a second display having user selectable options within a handicapped accessible range to provide access for disabled users. Upon receipt of a signal indicating a handicapped user, the second display is provided to allow access for handicapped users to insure they can adequately input their selections.

26 Claims, 19 Drawing Sheets

ADA CONVERTIBLE INPUT DISPLAY

This is a divisional of application Ser. No. 09/174,518 filed Oct. 16, 1998.

BACKGROUND OF THE INVENTION

The present invention relates generally to fuel dispenser devices and, more particularly, to devices which are convertible to allow access to disabled persons.

In recent years, traditional gasoline pumps and service stations have evolved into elaborate point-of-sale devices having sophisticated controller electronics and user devices with large displays and touch pads or screens. A customer is not limited to the purchase of fuel at the dispenser. More recent dispensers allow the customer to purchase services, such as car washes, and goods, such as fast-food or convenience store products at the dispenser. The fuel dispensers include displays showing various goods and services that are available at the service station. The dispenser includes input devices for the user to select the desired menu option. The display screens and input devices are often located on the fuel dispensers at elevated positions which provide for easy viewing. A drawback of this placement is that disabled persons, such as those in wheelchairs, are unable to access the input devices to select the various goods and services from the menu options. These persons are either required to seek the assistance of others or to forego the goods and services offered at these locations.

Regulations required by the Americans with Disabilities Act (ADA) have focused on providing accessibility to customer devices for disabled persons. One of the specific requirements is that no input devices be placed above 48 inches from either the ground or fueling dispenser platform. This requirement allows for disabled persons, especially those in wheelchairs, to be able to interact with the dispenser.

A drawback to the ADA requirements is that the presently available display screens and input devices are not accommodating to the various fuel dispenser users. When the display screen and input devices are placed at elevated positions, disabled persons cannot access the menu options positioned at the upper sections of the display. When placed to accommodate disabled persons, the display screen and input devices are difficult for others to access. It is further economically infeasible or physically impossible to place two separate display screens and input devices within the fuel dispenser.

SUMMARY OF THE INVENTION

The present invention relates to a fuel dispenser which is located in a fueling environment such as a convenience store or a quick serve restaurant. The fueling dispenser includes a display providing menu options and input devices for the user to select various goods and services available at the store or restaurant. The display includes a first display and input devices for a first interaction. Upon receipt of a signal indicating a handicapped user, the display changes to a second display to allow access for handicapped users. The second display has the input devices located within a handicapped accessible range allowing for handicapped users to select the desired goods and services.

Accordingly, one aspect of the present invention is to provide a handicapped accessible display system. The system includes a fuel dispenser for dispensing a consumable energy source into the user's vehicle. A user device associated with the fuel dispenser displays user selectable options for the user to select menu options for purchasing other goods and services. The user device selectively provides a first display screen for a first interaction and a second display screen when a disabled person is using the fuel dispenser.

Preferably, the user selectable options of the second display are positioned below a preselected level. In one preferred embodiment, the user selectable options are positioned below about 48 inches. The display system preferably includes a dispenser controller which receives a signal indicating a handicapped user is at the fuel dispenser and changes from the first display to the second display. The signal indicating a handicapped user may be either input directly by the user through a device such as a keypad, soft keys, or touch screen. Alternatively, the signal may be input indirectly through communication electronics which includes a receiver for detecting radio frequencies, infrared signals, voice activation, presence indication, or acoustic and audible signals such as a personal device held by the user or a car horn The present invention may further be used in an environment other than a fuel dispenser. This embodiment includes a kiosk having a display for providing user selectable options. Input devices correlating with user selectable options provide for the user to input the appropriate selections. The input devices are further associated with a controller which registers and tracks the user selections. The display system selectively provides between a first display having user selectable options for a first interaction and a second display wherein the user selectable options are configured to be accessible to disabled persons.

Another aspect of the present invention is for displaying information and receiving input from a user. The invention comprises a user interface for displaying user selectable options which prompts information from the user. The user interface provides information in a variety of orientations and selectively displays a first display for a first interaction or a second display which is accessible for disabled persons. Input devices correspond with the user selectable options of both the first and second displays. The input devices are assigned a first value for the first display and a second value for the second display.

Preferably, a controller is associated with the user device for receiving a signal indicating a disabled user and changing from the first display to the second display. The user selectable options of the second display are within a handicapped accessible range to provide access for the disabled users. The user selectable options of the second display are repositioned relative to the first display to insure they are within the handicapped accessible range. Repositioning can be achieved by a second display which has a reduced aspect ratio relative to the first display, a second display having a smaller vertical height relative to the first display, a tiered display screen format providing for options on succeeding displays, or linking the user selectable options from the first display to the second display.

The present invention is also drawn to a fuel dispensing system for displaying menu options. The system has first and second input devices which both correspond to the menu options and provide for the user to input the menu options. The first input device may be placed at any position on the fueling dispenser. The second input device is positioned within a handicapped accessible range. A controller controls the displays and input devices. Upon receipt of a signal indicating the presence of a disabled user, the controller activates the second input device to allow access for the disable user.

These and other aspects of the present invention will become apparent to those skilled in the art after reading the following description of the preferred embodiments when considered with the drawings.

BRIEF DESCRIPTION OF THE DRAWINGS

The invention will be better understood after a reading of the Detailed Description of the Preferred Embodiment and a review of the drawings in which.

DESCRIPTION OF THE PREFERRED EMBODIMENTS

Figure 1:
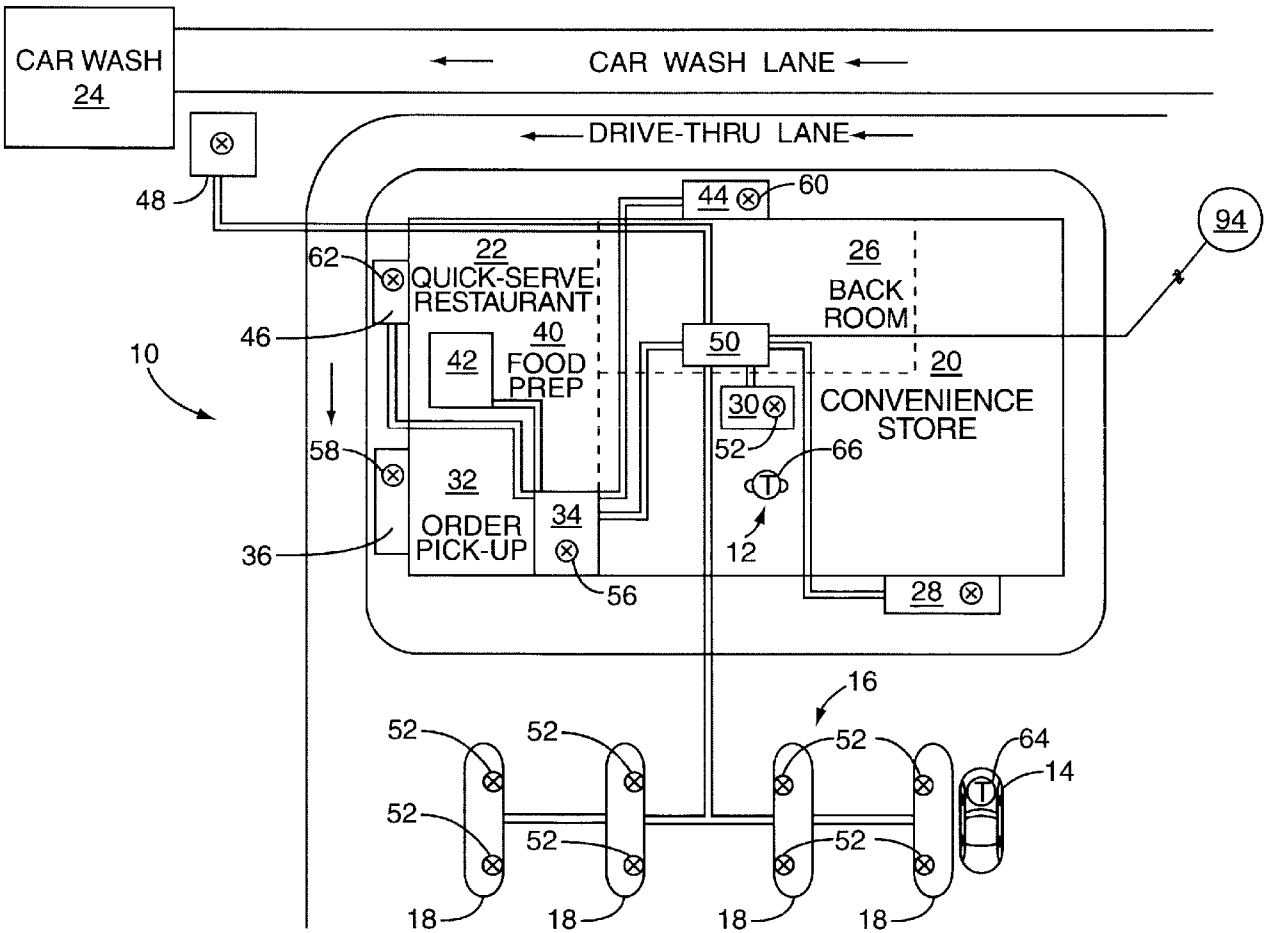
FIG. 1 is a schematic representation of a fueling and retail environment constructed according to the present invention.

In the following description, like reference characters designate like or corresponding parts throughout the several figures. It should be understood that the illustrations are for the purpose of describing preferred embodiments of the invention and are not intended to limit the invention thereto. Given the nature of the present application, an overview of the necessary hardware for the various areas in the fueling environment will be discussed followed by a description of the various functional aspects of the system and how the customer will react and interact with the system during various types of transactions.

Basic Structural Overview

As best seen in FIG. 1, a fueling and retail environment, generally designated 10, is shown constructed according to the present invention. The fueling and retail environment provides customers 12 the opportunity to purchase fuel for their vehicles 14 as well as other goods and services, such as fast food and car washes. The fueling and retail environment 10 may include one or more of a forecourt 16, where the fuel dispensers 18 are located, a convenience or fuel station store 20, one or more quick-serve restaurants (QSR) 22, a car wash 24, and a backroom 26. The backroom 26 is generally the central control area for integrating or coordinating control of the dispensers 18, convenience store 20, QSR 22, and car wash 24.

The convenience store 20 typically includes an inventory of a wide assortment of products, ranging from beverages and foods to household goods. The convenience store includes a transaction terminal or register 30, where a customer 12 may purchase convenience store products, fuel, car washes or QSR food.

The QSR 22 generally includes an order pick-up area 32 having a QSR transaction terminal or register 34 located within the convenience store and a drive-through terminal and window 36. Depending on the application, the QSR transaction terminal 34 and drive-through terminal 36 may be separated or integrated in any fashion. Usually, customers are able to place orders at the QSR transaction terminal 34 in the store as well as pick up orders in conventional drive-through style at drive-through terminal 36.

The QSR 22 may also include a food preparation area 40, a food preparation interface 42 for providing order instruction to QSR food preparers, a drive-through order placement interface 44 for placing drive-through orders in a conventional manner, and a customer position display 46 for determining the location or position of a customer in line to pick up a QSR order at the drive-through window 36. Notably, the drive-through and car wash lanes depicted in FIG. 1 are designed to control the flow of traffic through the respective lanes and aid to ensure vehicles, and their respective transponders, pass by the various interrogation points in the fueling environment as desired.

The car wash 24 includes a car wash interface 48 that interacts with the customer and controls the automatic car wash system (not shown), which may be any suitable automatic car wash. Preferably, a customer 12 will be able to order a car wash at a fuel dispenser 18, at the transaction terminal or register 30 of the convenience store 20, at the QSR transaction terminal 34, or at the car wash interface 48 directly. Similarly, customers are able to order fast-food items from the QSR 22 from various locations in the fueling environment 10, including at the fuel dispensers 18, drive-through order placement interface 44, and the in-store QSR terminal 34.

Although various overall system and control integration schemes are available, the four major parts of a typical fueling environment 10—forecourt 16, convenience store 20, QSR 22 and car wash 24—typically interface at the backroom 26 using a central control system 50. The central control system 50 may include any number of individual controllers from the various parts of the fueling environment 10 to provide overall system control and integration. The central control system 50 generally interface with the fuel dispensers 18, transaction terminal 30, QSR transaction terminal 34 and the car wash interface 48. Preferably the drive-through terminal 36, drive-through order placement interface 44 and customer position display 46 directly interface with the drive-through terminal 36 in order to integrate the QSR functions prior to interfacing with the central control system 50. Additionally, an automated vending system 28 may also interface with the central control system 50 or directly with any one of the other areas of the fueling environment 10, such as the fuel dispensers 18, in order to allow a customer 12 to purchase products from the vending system 28 at a remote location. Those of ordinary skill in the art will recognize several control variations capable of implementing an integrated system.

Figure 2:
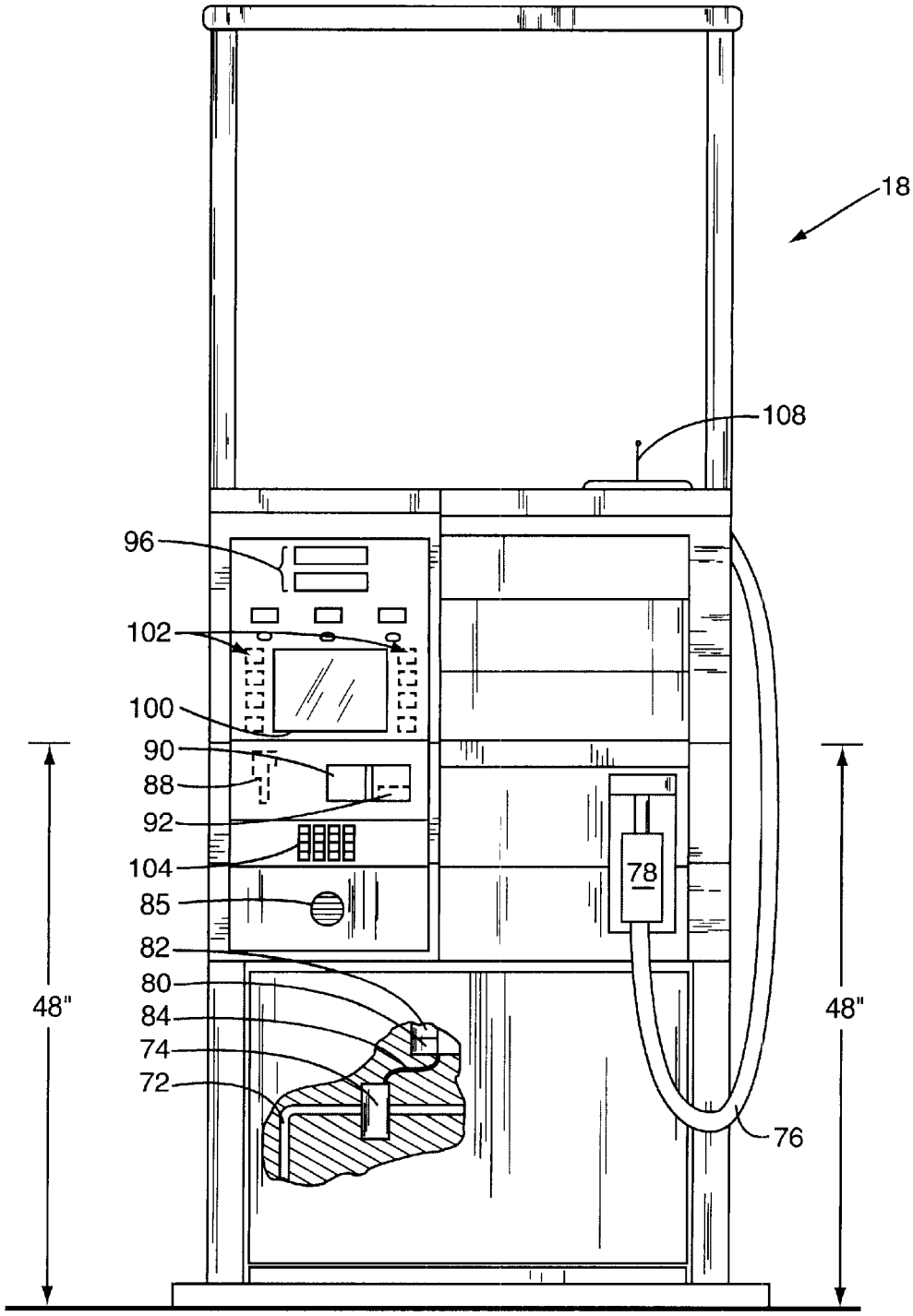
FIG. 2 depicts a fuel dispenser shown constructed according to the present invention.

As best seen in FIG. 2, a fuel dispenser 18 is shown constructed according to and as part of the present invention. The dispenser provides a fuel delivery path from an underground storage tank (not shown) to a vehicle 14, (shown in FIGS. 1 and 3A). The delivery path includes a fuel delivery line 72 having a fuel metering device 74. The fuel delivery line 72 communicates with a fuel delivery hose 76 outside of the dispenser 18 and a delivery nozzle 78. The nozzle 78 provides manual control of fuel delivery to the vehicle 14.

The dispenser 18 also includes a dispenser control system 80 having one or more controllers and associated memory 82. The dispenser control system 80 may receive volume data from the metering device 74 through cabling 84 as well as provide control of fuel delivery. The dispenser control system 80 may provide audible signals to an audio module and speaker 86 in order to provide various beeps, tones and audible messages to a customer. These messages may include warnings, instructions and advertising.

The dispenser 18 is preferably equipped with a payment acceptor, such as a card reader 88 or cash acceptor 90, along with a receipt printer 92. With these options, the dispenser control system 80 may read data from the magnetic strip of a card inserted in the card reader 88 or receive cash from a customer and communicate such information to the central control system 50 (as shown in FIG. 1), such as the G-site controller sold by Gilbarco Inc., 7300 West Friendly Avenue, Greensboro, N.C. The central control system 50 typically communicates with a remote network 94, such as a card verification authority, to ascertain whether a transaction proposed to be charged to or debited from an account associated with the card inserted in the card reader 88 is authorized.

The dispenser 18 will include one or more types of displays, preferably one or more alpha-numeric displays 96 together with a high-resolution graphics display 100. The display 100 is preferably a high resolution for ease in viewing and may include a liquid crystal display (LCD) or cathode ray tube (CRT). The screen may be divided into any number of separate screens depending on the specific application. The display 100 will generally have an associated input device, such as soft keys 102, adjacent to the display or integrated with the display to provide a touch interface, such as a touch screen. The dispenser may include an additional, auxiliary key pad 104. Any of the input devices may be associated with the card reader 88 for entering secret codes or personal identification numbers (PIN's). Notably, the displays 96, 100 and input devices 102, 104 may be integrated into a single device and/or touch interface. The dispenser control system 80 is preferably comparable to the microprocessor-based control systems used in CRIND (card reader in dispenser) and TRIND (tag or transponder reader in dispenser) type units sold by Gilbarco Inc. under the trademark THE ADVANTAGE.

Figure 3:
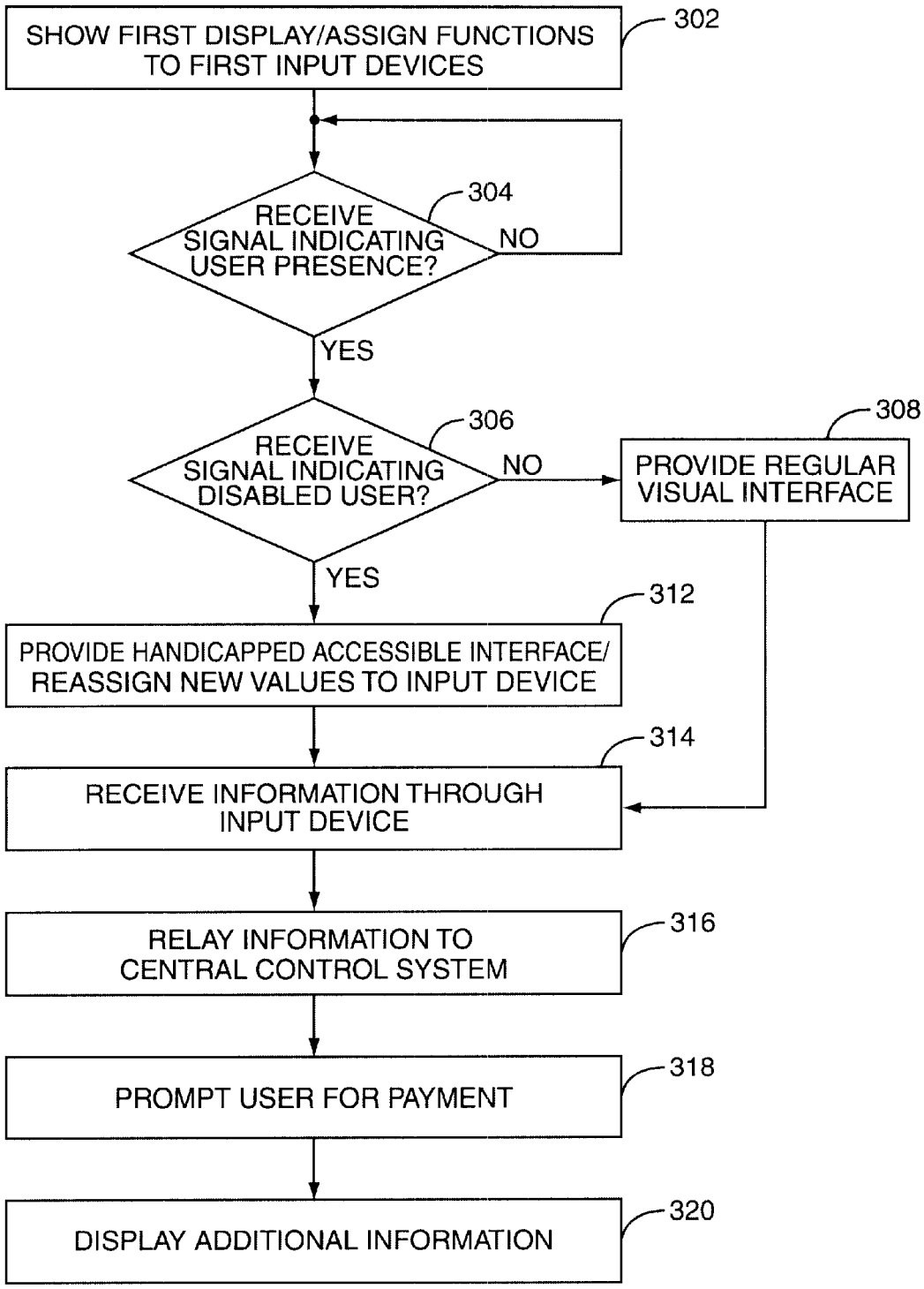
FIG. 3 is a schematic representation of the function of the dispenser controller according to the present invention.

The overall function of the dispenser controller 80 is illustrated in FIG. 3. Typically, the first display is shown on the display of the fuel dispenser 18, and functions corresponding to the display are assigned to the input devices (Block 302). For example, menu options on the display are assigned to corresponding soft, hard, or touch keys. Next, the dispenser controller awaits receipt of a signal indicating the presence of a user (Block 304). Once the dispenser controller 80 determines the presence of a user, the signal is processed to determine if the customer is disabled (Block 306). The signal indicating customer presence may be generated by the dispenser when the customer is initially interacting with any part of the dispenser or upon receiving an external signal from a transponder, transmitter, acoustic or other signal transmitting device. The dispenser may determine whether a customer is disabled by a specific input or selection at the interface, the type of signal transmitted to the dispenser or information carried by the signal.

If a disabled person is not present, the dispenser controller will provide a regular visual interface (Block 308) as there is no issue with accessibility. If a signal indicating a disabled user is present is received (Block 306), a second visual interface is provided that is handicapped accessible and the functions of the input devices are reassigned to allow for the user to access the various menu options (Block 312). In either situation, upon receipt of the user information via the input devices (Block 314), the information inputted by the user is then passed to the central control system (Block 316). The user is then prompted for payment (Block 318) to be paid at the fuel dispenser or at another point in the fueling environment such as the convenience store or QSR. Additional information may be displayed at the dispenser screen such as advertisements for additional goods or services, safety information, etc (Block 320). Once the transaction has been completed, the dispenser controller resets and begins another cycle.

Many areas within the fueling environment 10 may be equipped with communication electronics capable of providing uni- or bidirectional communications with the customer or vehicle carrying a remote communications device. The communication electronics will typically include a transmitter for transmitting signals to the remote communications device and a receiver for receiving signals emanating from the remote communications device. The remote communications device may also include a receiver and transmitter. The transmitter and receiver of the remote communications device may separately receive and separately transmit signals in cooperation with an associated control system or may be configured so that the transmitter actually operates on and modifies a signal received from the communication electronics in the fueling environment 10.

For the sake of conciseness and readability, the term "transponder" will be used herein to describe any type of remote communications device capable of communicating with the communication electronics of the fueling environment 10. The remote communications device may include traditional receivers and transmitters alone or in combination as well as traditional transponder electronics adapted to modify an original signal to provide a transmit signal. A transponder as defined herein may provide either unidirectional or bidirectional communications with the communications electronics of the fueling environment 10. Likewise, the communication electronics associated with the various aspects of the fueling environment 10 will be called an "interrogator." An interrogator will generally include a transmitter and receiver capable of communicating with a transponder as defined above. Please note that an interrogator, as defined herein, need not contain both a receiver and a transmitter for various aspects of the invention. In fact, certain embodiments of the invention would only require a receiver configured to receive any signal indicative of the presence of a handicapped person at the dispenser.

Figure 4A:
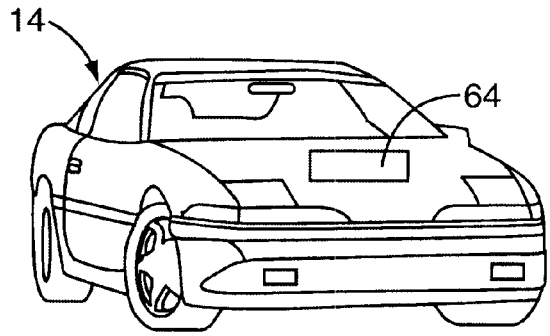
FIG. 4A depicts a vehicle having a vehicle-mounted transponder constructed according to the present invention.
Figure 4B:
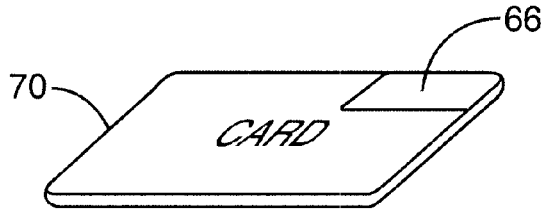
FIG. 4B depicts a personal transponder integrated into a debit/credit or smartcard constructed according to the present invention.
Figure 4C:
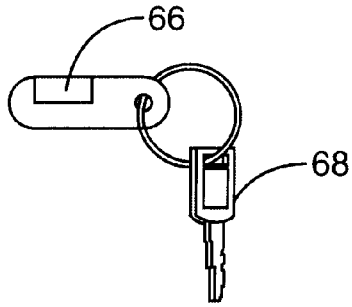
FIG. 4C depicts a personal transponder integrated into a key fob constructed according to the present invention.

As shown in FIGS. 4A, 4B and 4C, the dispenser interrogator 52 are preferably adapted to communicate with vehicle-mounted transponders 64 and personal transponders 66. The personal transponder 66 may be mounted on a key fob 68, a wallet card 70, or any other device typically carried by the customer 12, as shown in FIGS. 3B and 3C. FIG. 3A depicts a vehicle 14 having a vehicle-mounted transponder 64.

The levels of sophistication of the vehicle-mounted transponder 64 may vary drastically. The transponder 64 may be integrated with the vehicle's main computer and control system, or may simply be a sticker placed on a window or on another part of the vehicle. The transponder 64 may be active or passive, and may be adapted to either simply send out an identification number or carry out high-level communications and have the ability to process, store and retrieve information. The transponder may be configured in its most simple form to include only a transmitter to transmit signals indicative of the presence of a handicapped person.

As noted, the dispenser control system 80 may include or be associated with dispenser communication electronics referred to as interrogator 52 for providing remote unidirectional or bidirectional communications between a transponder and the dispenser. These transponders may incorporate Texas Instruments' RFID technology; the Micron Microstamp™ produced by Micron Communications, Inc., 8000 South Federal Way, Boise, Id. 83707-0006; or any number of like communication systems. The Micron Microstamp™ engine is an integrated system implementing a communications platform referred to as the Microstamp™ standard on a single CMOS chip. A detailed description of the Microstamp™ engine and the method of communication is provided in its data sheets in the Micron Microstamp™ Standard Programmers Reference Manual provided by Micron Communications, Inc. These references and the information provided by Micron Communications on their web site at http://www.mncc. micron.com are incorporated herein by reference.

Although the preferred communications method includes radio frequencies in the microwave range, these communications may include infrared, acoustic or other known remote communication methods acceptable for use in a fueling environment. Additionally, the dispenser 18 may include one or more antennas 108 associated with the dispenser interrogator 52. Each dispenser may include one interrogator adapted to cover both fueling positions or have one interrogator per fueling position.

The communication system preferably communicates using substantially directional radio frequencies in conjunction with antennas configured to provide precisely shaped and directed interrogation fields. Communications at these frequencies are generally limited to line-of-sight communications wherein arranging the antennas to cover a common interrogation field from different locations avoids parallax and the effect of interference from objects coming between the transponder and one of the antennas. Generally, communications will require the absence of metal objects coming between the antennas and transponders. Thus, when antennas are mounted within the dispenser, glass or plastic dispenser walls are preferable. Furthermore, vehicle-mounted transponders are preferably placed on the windows, behind non-metal portions of the vehicle to avoid interference, or in positions allowing reflections to reach the communication electronics associated with the dispenser.

Preferably, high-gain antennas are used to provide a highly directional and configurable cone shape covering an area most likely to include a transponder when a vehicle is properly positioned for fueling. The antenna range and transmission power is typically adjusted to provide the desired interrogation field while minimizing the potential for the transponder to reflect signals to antennas associated with other fueling positions.

Figure 5:
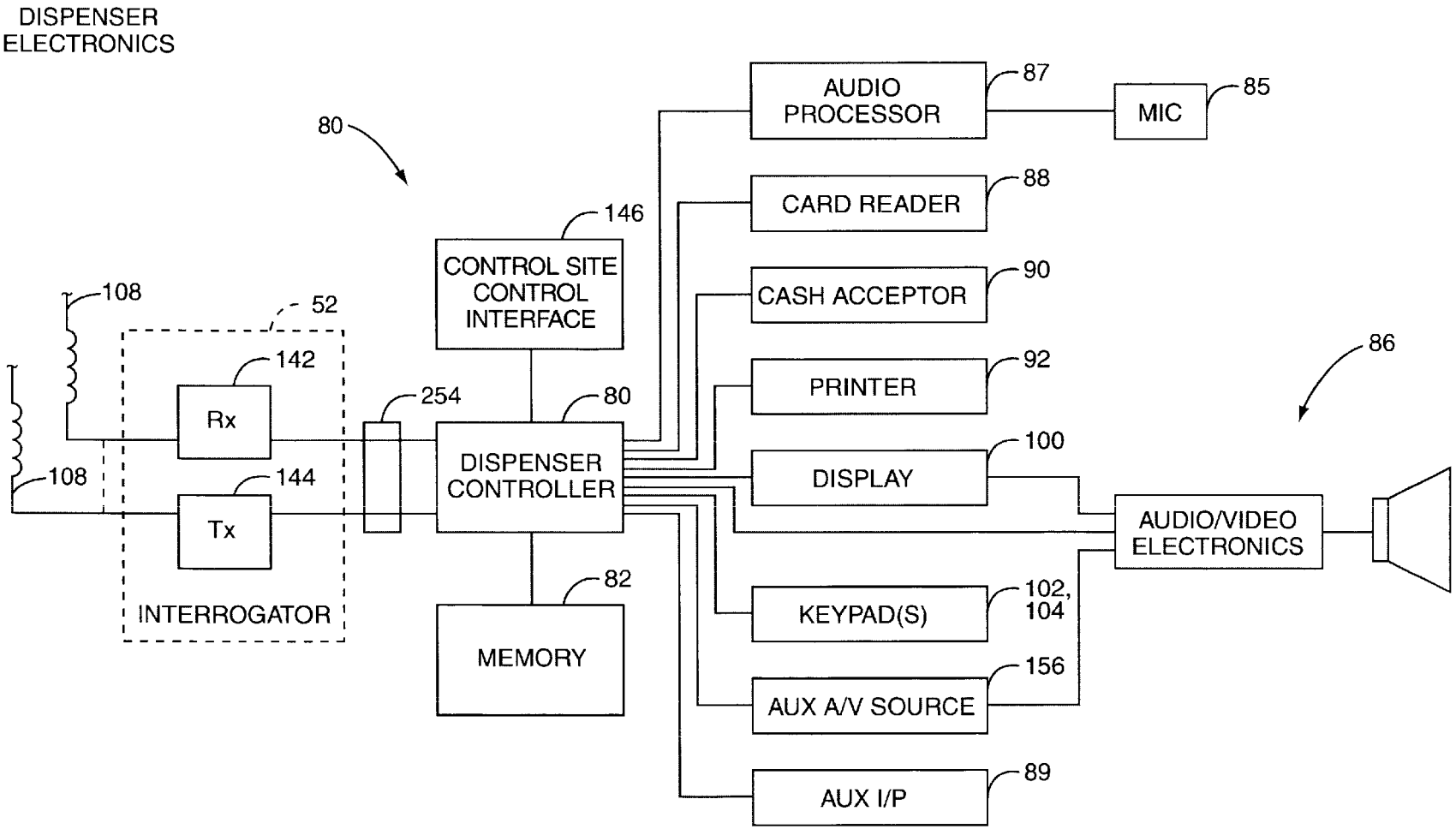
FIG. 5 is a schematic representation of fuel dispenser electronics constructed according to the present invention.

FIG. 5 illustrates a basic schematic overview of the dispenser electronics wherein a dispenser control system 80 includes a controller 81 associated with the memory 82 to interface with the central control system 50 through an interface 146. The dispenser control system 80 provides a graphical user interface with key pad 102 and display 100. Audio/video electronics 86 are adapted to interface with the dispenser control system 80 and/or an auxiliary audio/video source 156 to provide advertising, merchandising and multimedia presentations to a customer in addition to basic transaction functions. The graphical user interface provided by the dispenser allows customers to purchase select goods and services other than fuel at the dispenser. The customer may purchase a car wash and/or order food from the QSR while fueling the vehicle. The customer may be provided a video menu at the display 100 to facilitate selection of the various services, goods and food available for purchase. The dispenser control system may also include a microphone 85 and associated audio processor 87, if necessary, to receive audible signals indicative of the presence of a handicapped person. The audible input may be voice or generated tones from handheld or vehicle mounted devices. In such embodiments, the control system 80 and/or audio processor 87 will be able to recognize and decipher the voice and/or other audible data. Any other type of signal or input may be used to indicate such presence at the dispenser using a corresponding auxiliary input device or reader 89.

The card reader 88 and cash acceptor 90 allow the customer to pay for any of the services, goods or food ordered at the dispenser while the printer 92 will provide a record of the transaction. The dispenser control system 80 is operatively associated with a dispenser interrogator 52, which has a receiver 142 and a transmitter 144. The receiver 142 and transmitter 144 typically associate with one or more antennas 108 to provide remote communications with a transponder. The dispenser control system 80 communicates with the central control system 50 in the backroom 26. Control may be distributed in varying degrees between the dispenser control system 80 and the central control system 50.

Operational Overview

Figure 6A:
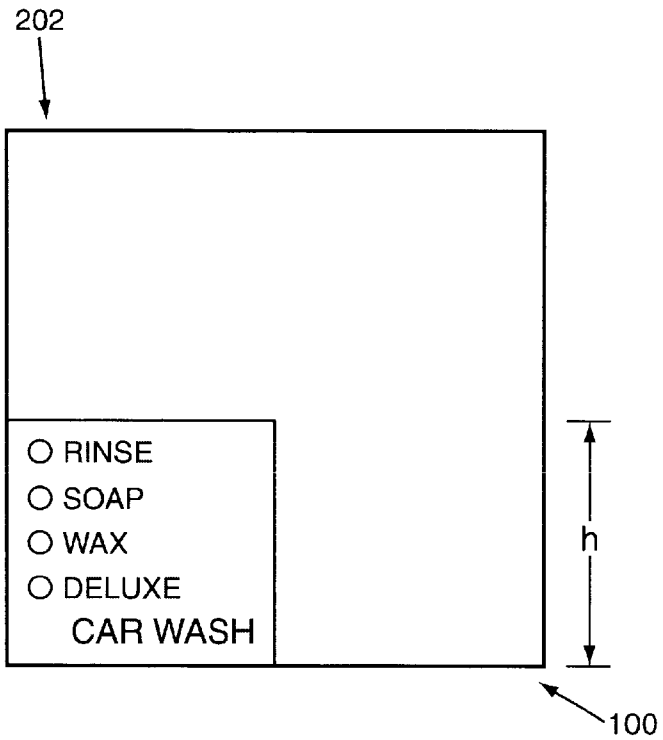
FIG. 6A is a front view of a second display screen and input devices having the same menu options of FIG. 6.
Figure 6:
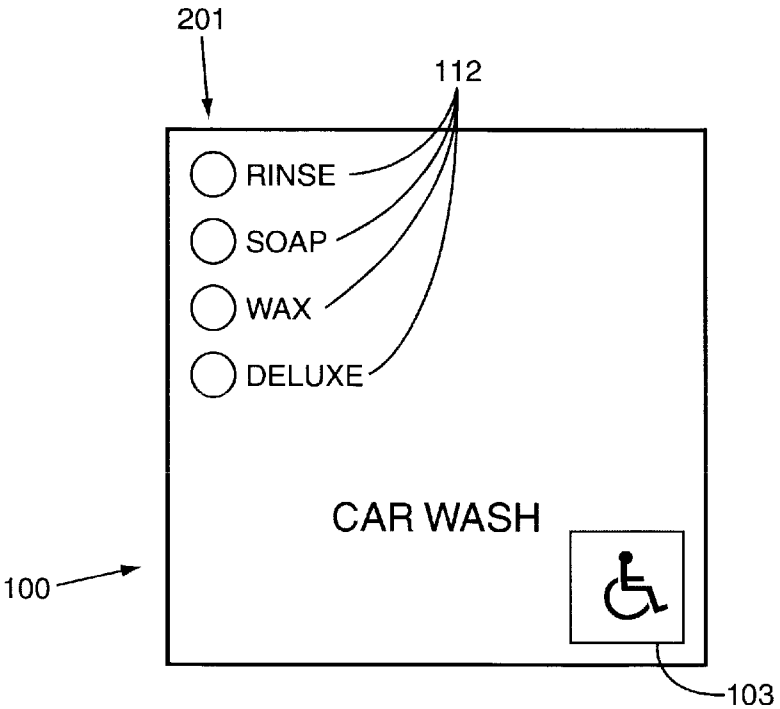
FIG. 6 is a front view of a first display screen having menu options and touch screen input devices.

With reference to FIGS. 5 and 6, the dispenser controller 80 generally controls the visual interface provided by the display 100 and the functions assigned to the input devices. A first display 201 having menu or user selectable options is shown on the display and a first set of functions is assigned to each of the input devices.

When a user pulls up to the fuel dispenser, the first display 201 appears on the display 100. Typically, this first display 201 is configured for non-handicapped interactions and may provide directions or a selection to convert to a more accessible configuration. The first display 201 may include any portion of the display 100, regardless of height or size. The first display 201 will generally include menu options 112 to instruct the user to select the desired goods or services and/or indicate and control the fueling process. A number of separate screens may be shown depending upon the user's responses and the amount of goods and services available at the service station. When the user is physically able to access the dispenser device and/or does not provide any indication of being handicapped, the first display 201, and any subsequent screens, will not be altered.

To convert the dispenser interface into a handicapped accessible interface, the dispenser controller 80 will receive a signal from the user to change the display from a first display 201 (regular visual interface) to a second display 202 (visual interface configured to be handicapped accessible) when the user is disabled or otherwise unable to physically access the input devices of the first display. The signal triggering the screen change can be directly or indirectly provided by the user. Direct input are those in which the user touches the screen or a key or otherwise interacts with the interface. Examples of direct customer input includes actuating a soft key 102, a hard key 104, or a touch screen 103. Each of these direct user interface devices have at least portions located within the handicapped accessible range allowing access for the handicapped user. Indirect input triggers are those including the remote and wireless communications electronics previously discussed as well as an audible signal or voice command from a person, vehicle or other like device.

The term "handicapped accessible range" is meant to include the physical parameters of the placement of the input devices to allow access for disabled users. One example of a handicapped accessible range is the 48 inch maximum height requirement for receiving direct user input, as established by the ADA. It is understood that the present invention also contemplates various other handicapped accessible ranges that may provide better access for disabled users.

Figure 8:
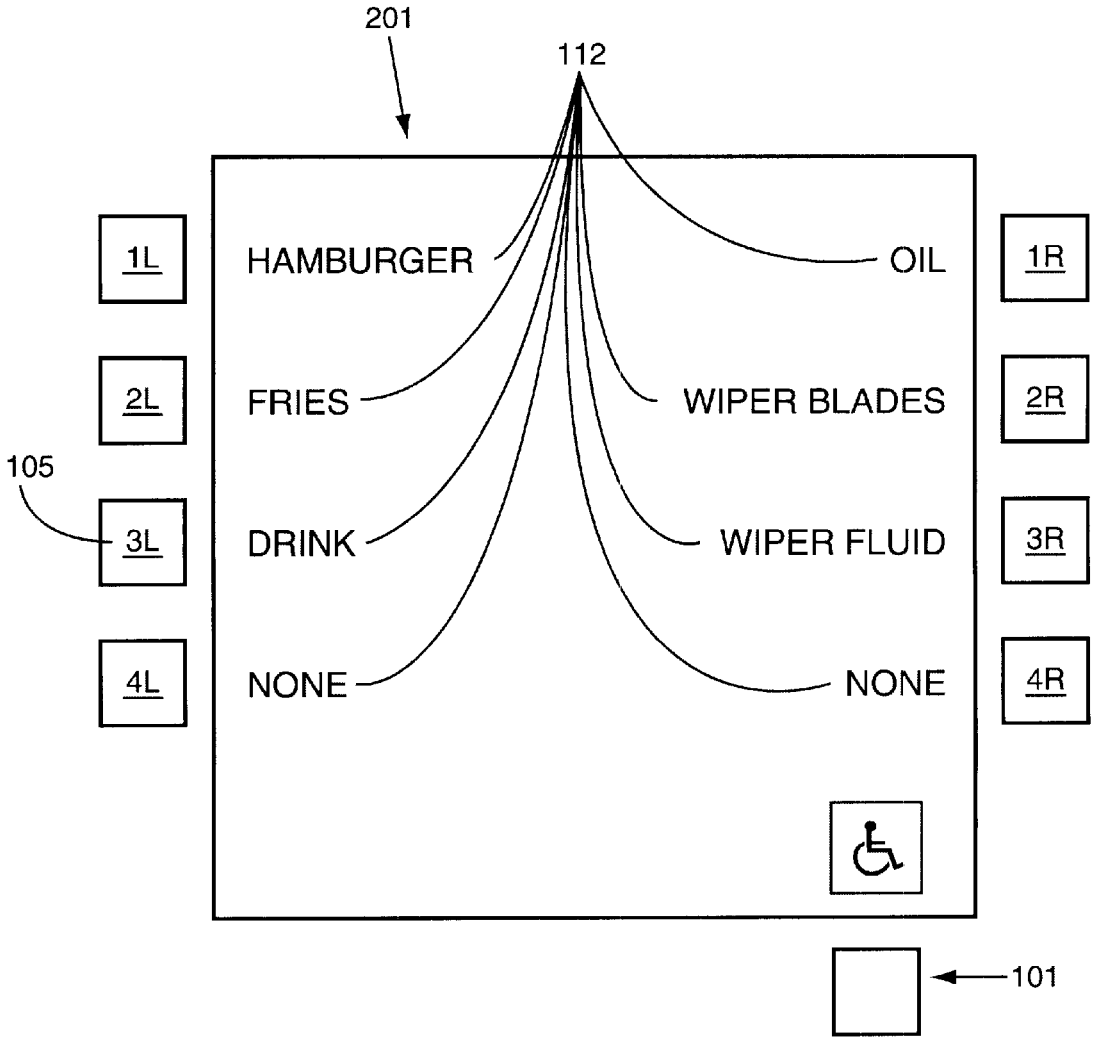
FIG. 8 is a first display screen and having input devices of adjacent soft keys.
Figure 8A:
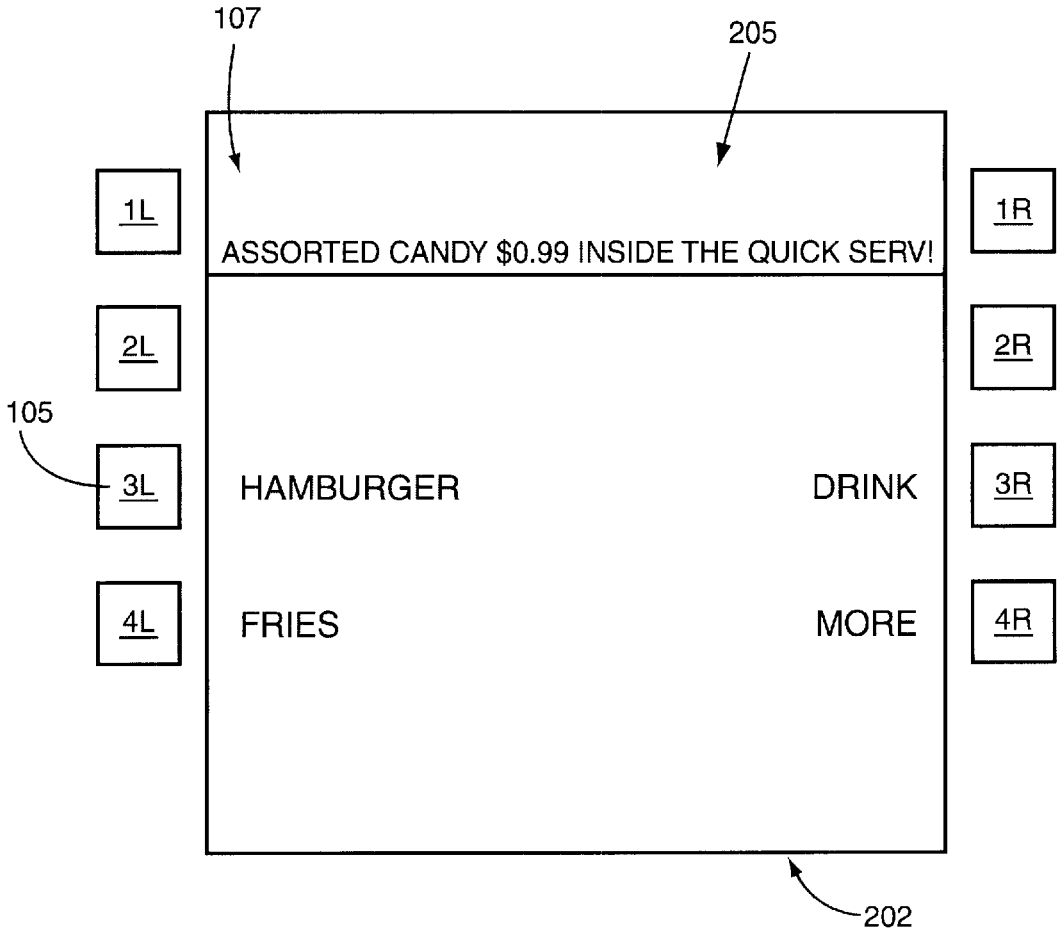
FIG. 8A illustrates a second display screen of a partial list of the menu options of FIG. 8.

Upon receipt of the signal indicating the presence of a disabled user, the dispenser controller 80 replaces the first display 201 with a second display 202. The user interface of the second display 202 is fully accessible and any soft, hard, or touch keys used to traverse the menus are within the handicapped accessible range. The dispenser controller 80 may reassign the values of the input device(s) to new values as appropriate. By way of example as illustrated in FIG. 8, soft key 2L corresponds to the menu option "Fries" in the first display screen 201 and assigned the appropriate value such as cost, inventory, or other information associated with "Fries" necessary to be tracked by the central control system 50. When the display is reconfigured for handicap accessibility, as illustrated in FIG. 8A, the menu options and values for the input devices are reconfigured for the second display. Soft key 2L is no longer assigned a value as there is no corresponding menu option, and soft key 3L which in the previous screen had been assigned the value "Drink" is now assigned the value "Hamburger".

The second display 202 contains the same information as the first display 201, although it may be in a different order or orientation to fit within the handicapped accessible range. The present invention contemplates a number of different orientations and positions for accomplishing this task. One example of the repositioning is illustrated in FIGS. 6 and 6A. FIG. 6 illustrates a first display 201 in a touch screen embodiment. A user orders the goods or services by touching the screen corresponding to the desired menu options 112. For disabled users, the aspect ratio of the screen is reduced in the second display 202 such that all menu options and input devices are within the handicapped accessible range and in particular, below a defined height (h).

Figure 7A:
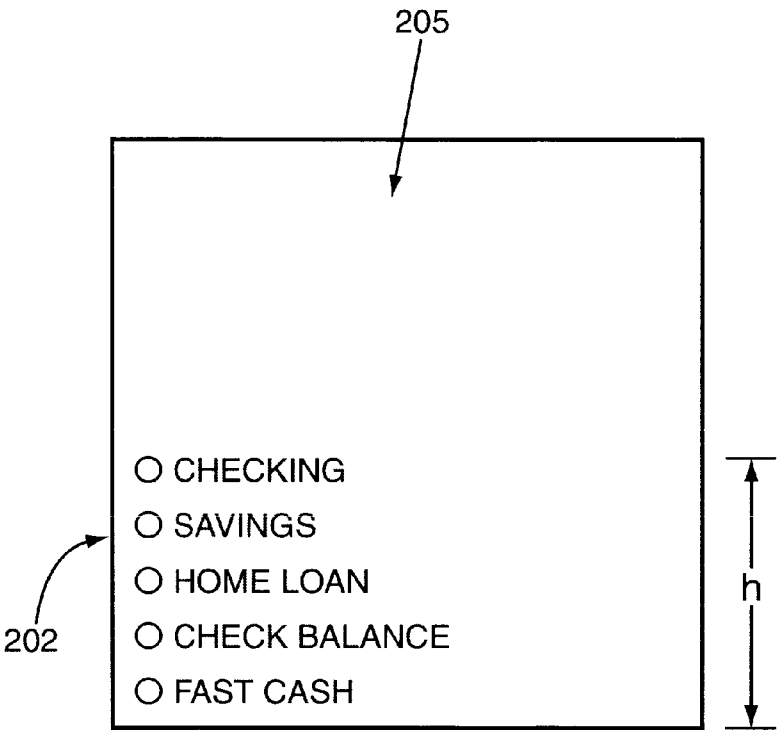
FIG. 7A is a front view of a second display screen and input devices having the information of FIG. 7.
Figure 7:
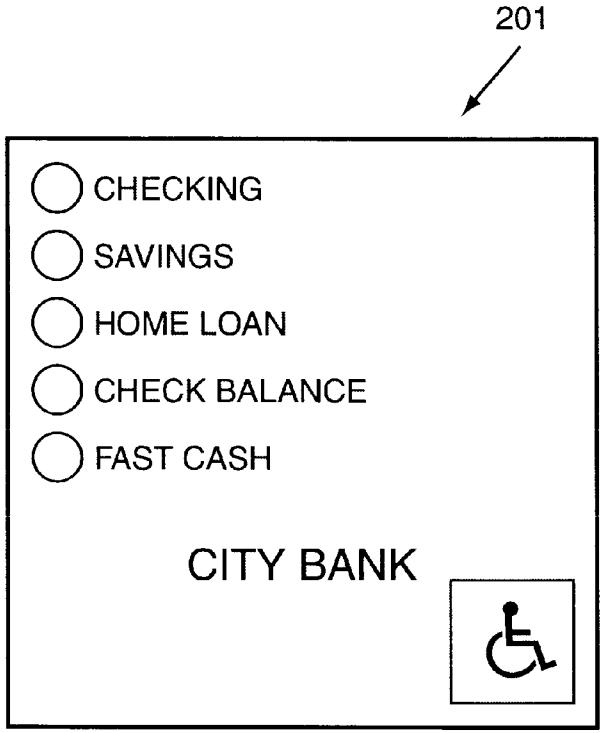
FIG. 7 is a front view of a first display screen having menu options and touch screen input devices.

A similar arrangement is illustrated in FIGS. 7 and 7A in which the second display 202 has a reduced screen height to allow for all menu options and input devices to be within the handicapped accessible range. The unused portion 205 of the second display defined as the area of the display not incorporated by the actual display screens may be used for other purposes including advertising, safety instructions, etc.

Figure 8B:
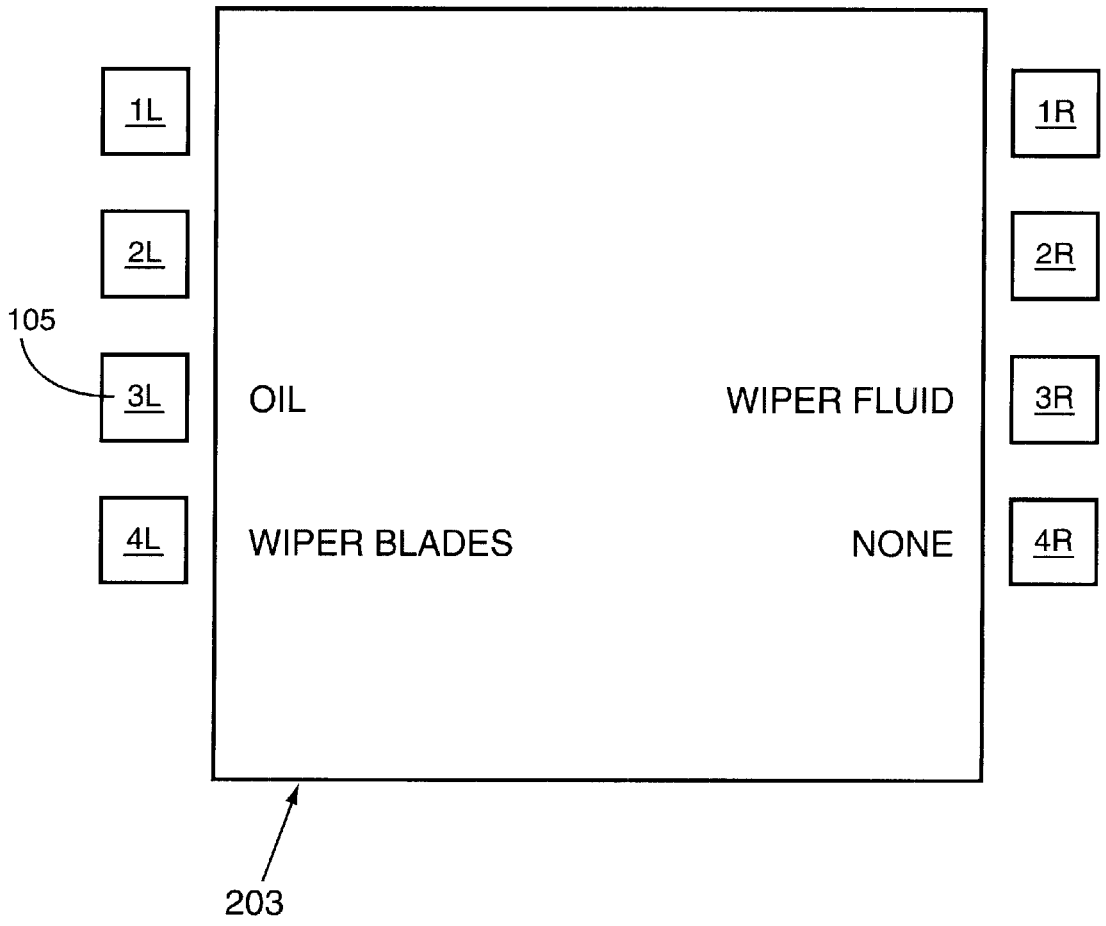
FIG. 8B illustrates a third display screen of a partial list of the menu options illustrated in FIG. 8.
Figure 9A:
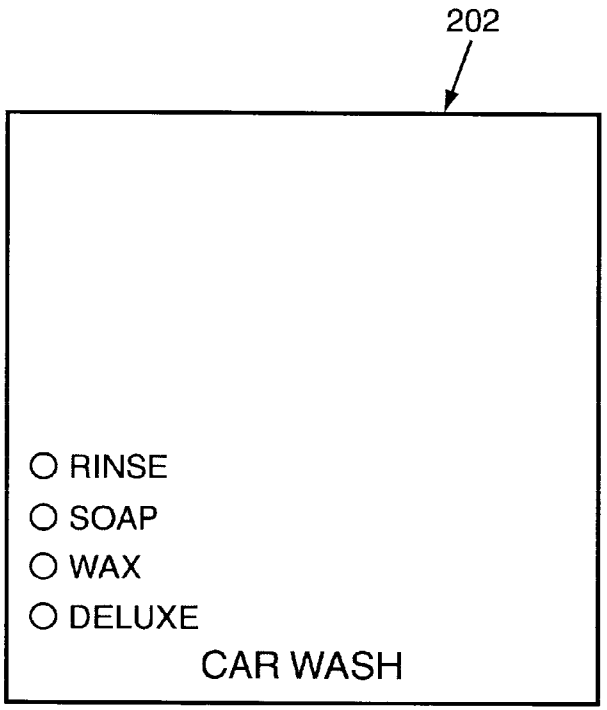
FIG. 9A is a front view of a second display screen of the information of FIG. 9.
Figure 9:
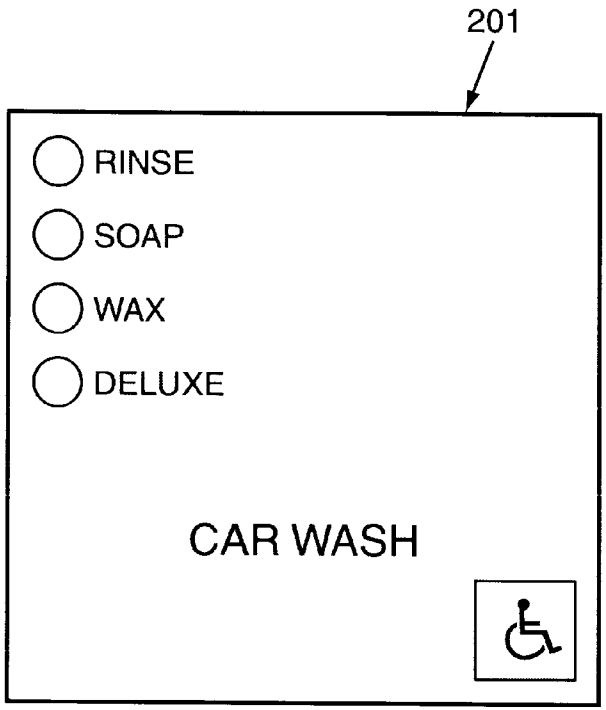
FIG. 9 is a front view of a first display screen having menu options and touch screen input devices.
Figure 10A:
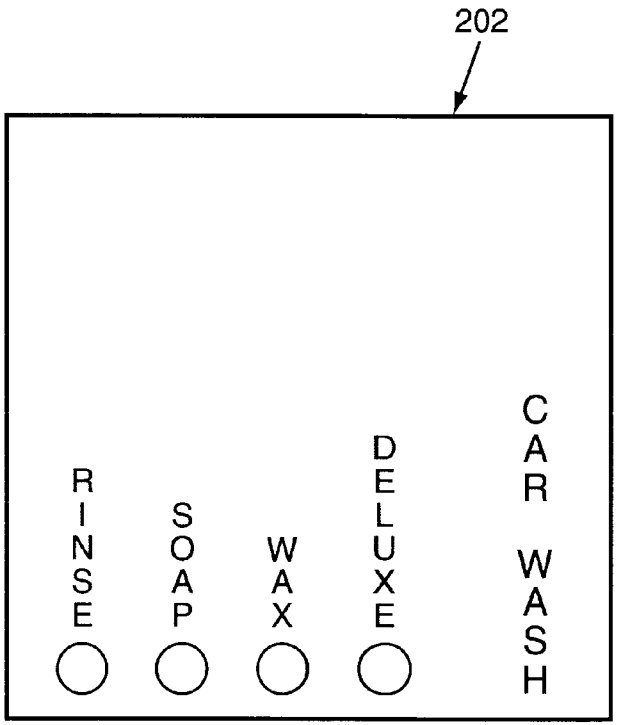
FIG. 10A is a front view of a second display screen of the information of FIG. 10.
Figure 10:
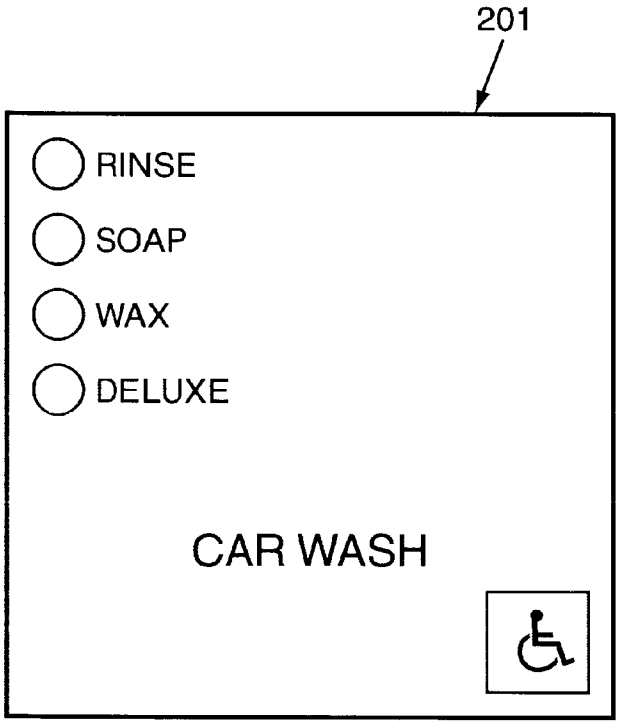
FIG. 10 is a front view of a first display screen having menu options and touch screen input devices.
Figure 11A:
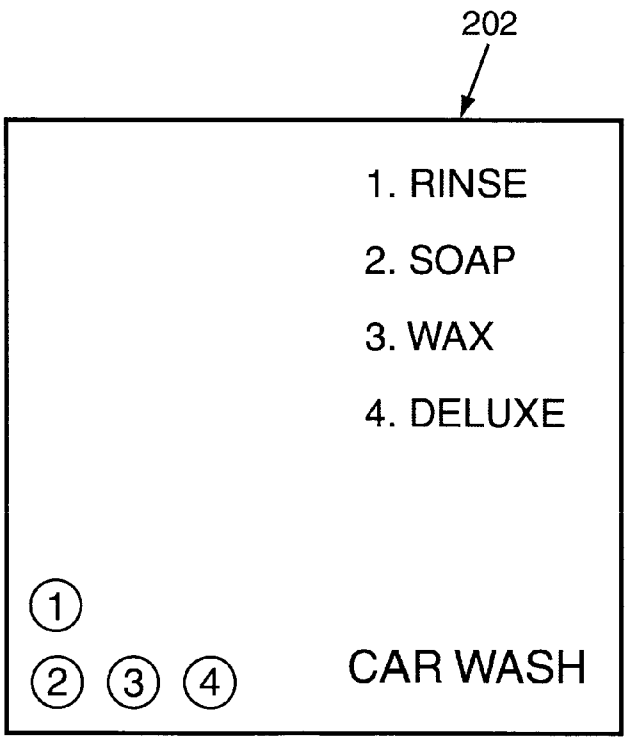
FIG. 11A is a front view of a second display screen of the information of FIG. 11.
Figure 11:
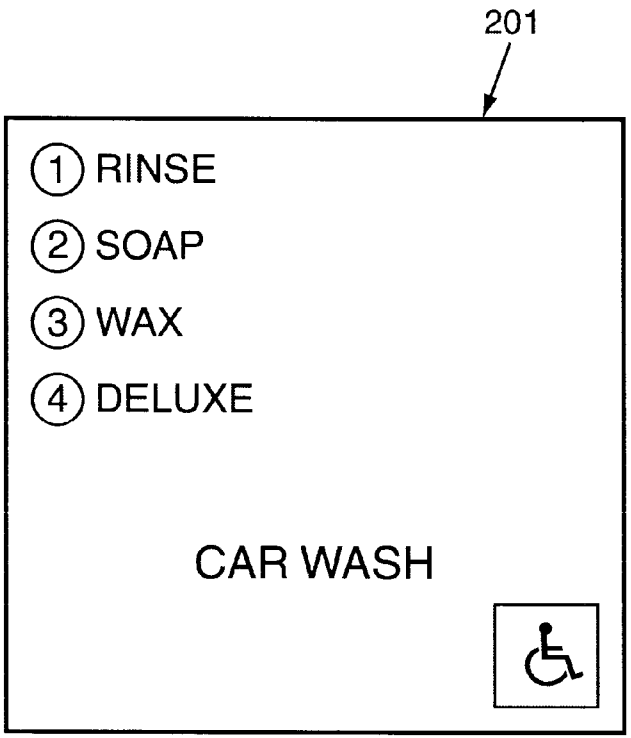
FIG. 11 is a front view of a first display screen having menu options and touch screen input devices.

A soft key embodiment is illustrated in FIGS. 8, 8A, and 8B. FIG. 8 illustrates a first display 201 using substantially the entire area of the display for menu options 112. Upon receipt of a signal that a disabled user is at the fueling dispenser, the display is basically reoriented with a second display 202 as illustrated in 8A. The area 205 not used by the menu options includes advertising information 107. FIG. 8B illustrates the third display 203 displaying the remainder of the initial menu options not displayed within the handicapped accessible range. FIGS. 9, 9A, 10, 10A, and 11, 11A illustrate alternative embodiments of repositioning the menu options on the second displays 202 to provide for the range requirements of a handicapped user. These embodiments illustrate the same four menu options as the first display 201 and various orientations of the menu options and input devices of the second displays 202. These figures are shown as touch screen embodiments but it will be understood that soft key or hard key embodiments are also possible. In such embodiments soft keys are adjacent menu options and/or bard keys are linked to these options.

Figure 13A:
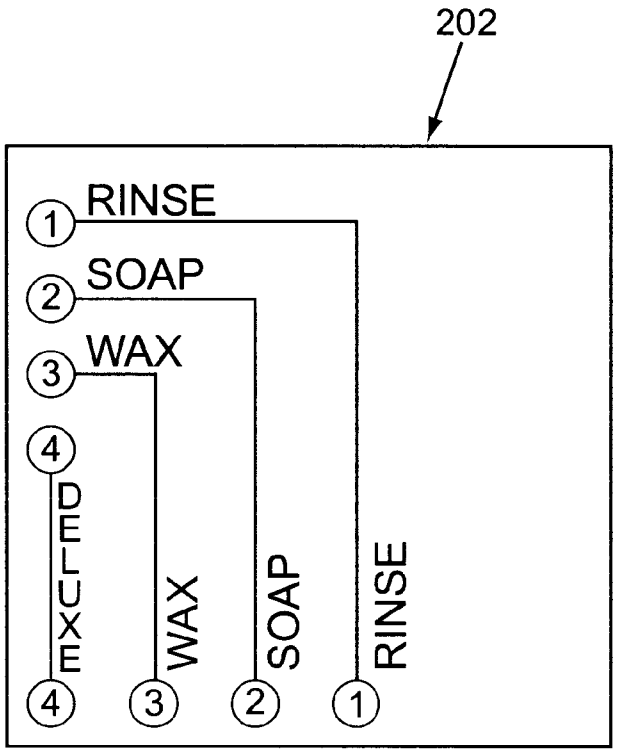
FIG. 13A is a front view of a second display screen having input devices linked together.
Figure 13:
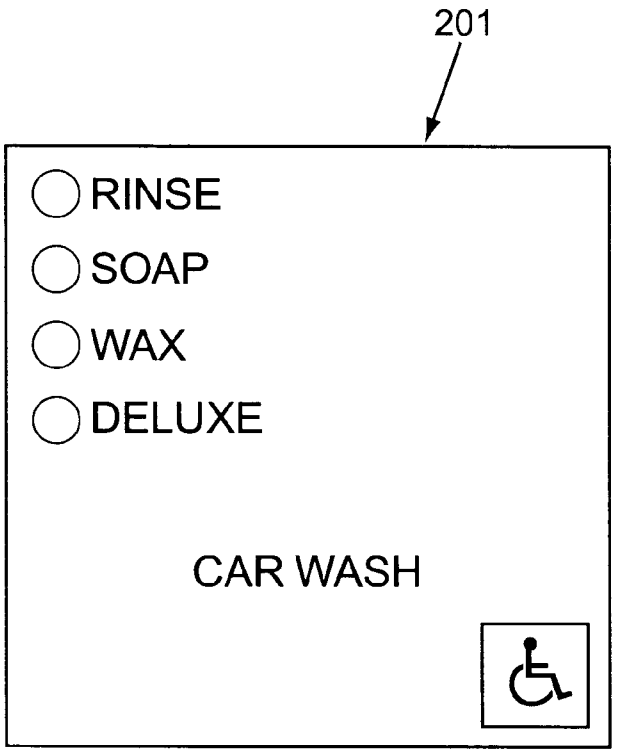
FIG. 13 is a front view of a first display screen having menu options and touch screen input devices.

FIGS. 13 and 13A illustrate another embodiment in which the menu options are linked with additional touch keys or soft keys. The links may be permanently placed on the first screen or added once the presence of a handicapped user is detected to keep the second display screen 202 menu options and input devices within the handicapped accessible range.

Figure 12:
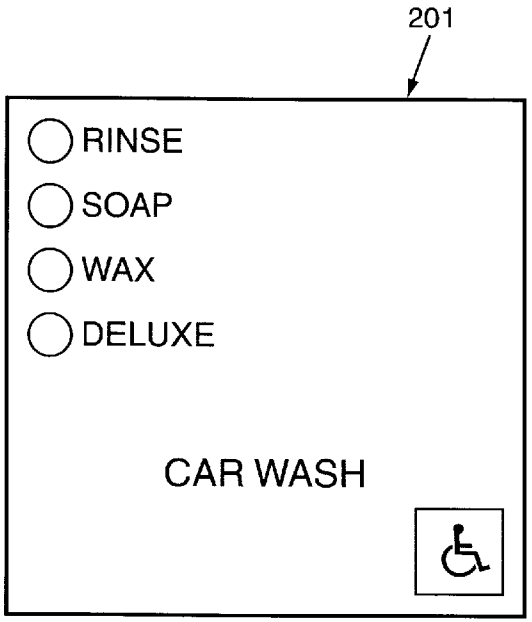
FIG. 12 is a front view of a first display screen having menu options and touch screen input devices.
Figure 12A:
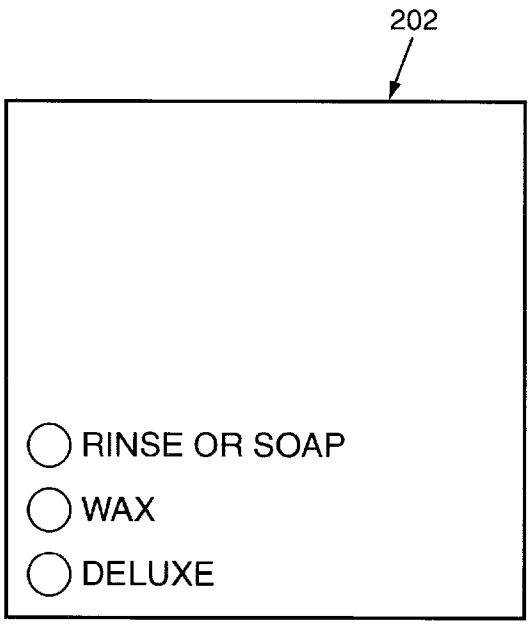
FIG. 12A is a front view of the menu options of FIG. 12 having a tiered arrangement.
Figure 12B:
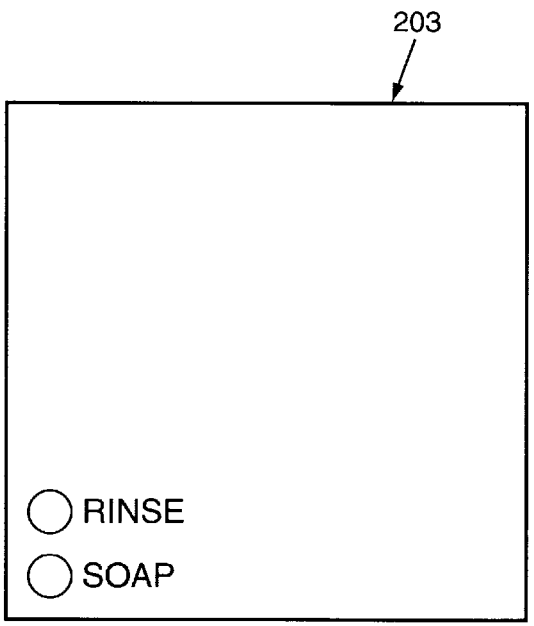
FIG. 12B is a front view of the two menu options tiered in FIG. 12A.

A tiering arrangement is illustrated in FIGS. 12, 12A and 12B. Tiering provides more than one menu option for a single input resulting in additional displays to individually display all of the available menu options and provide individual input devices. Tiering may be used when there is not adequate display area on the display to include the full variety of menu options within the requirements range. By way of example, FIG. 12 illustrates a first display 201 having four separate menu options with a touch screen input device. FIG. 12A illustrates a second display 202 having three menu options. Each of these options is within the handicapped accessible range but, as there is not adequate display area, two of the menu options "Rinse or Soap" are combined into a single menu option and input device. Upon selection of the input device and menu option "Rinse or Soap", the third display 203 would be displayed allowing the user to specify the specific menu option of interest, either "Rinse" or "Soap".

Figure 14:
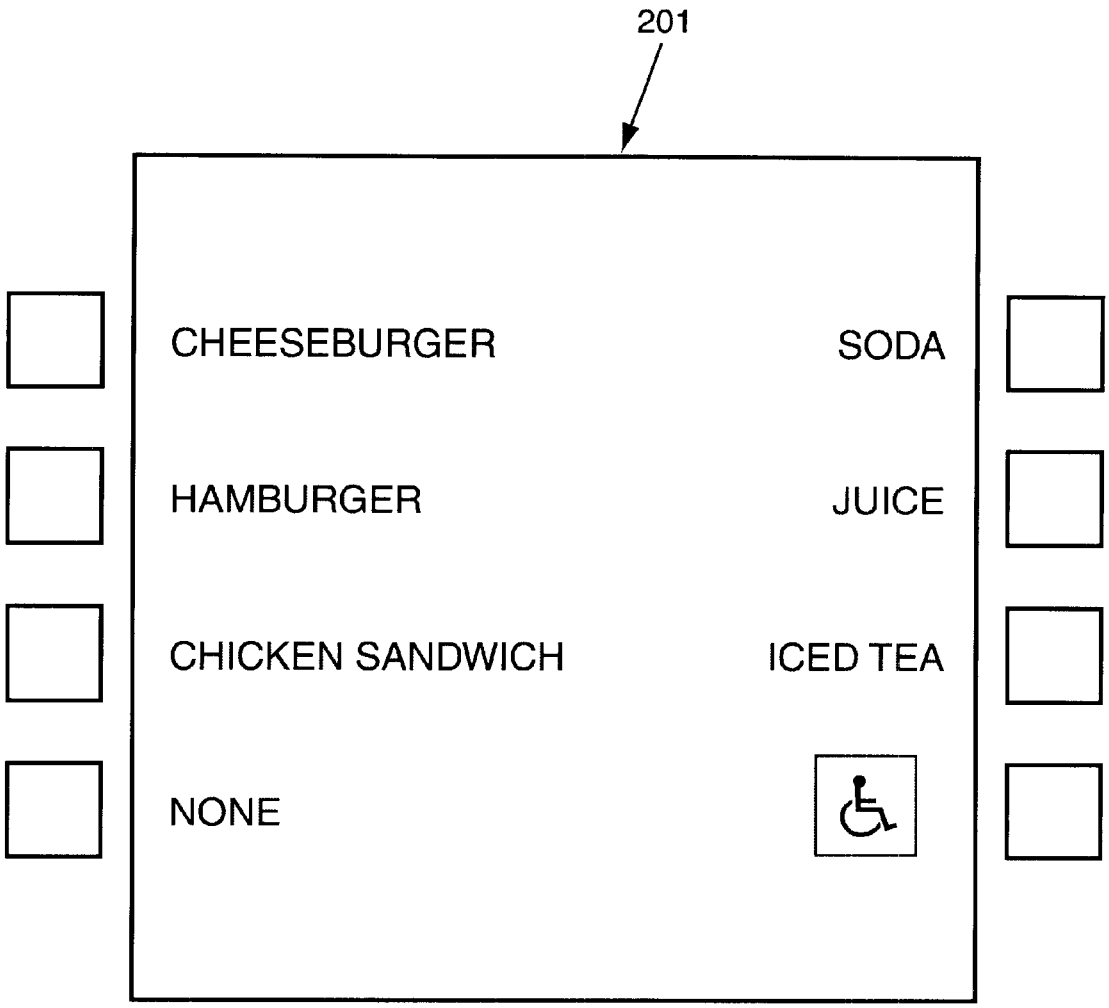
FIG. 14 illustrates a first display screen having input devices of adjacent soft keys.
Figure 14A:
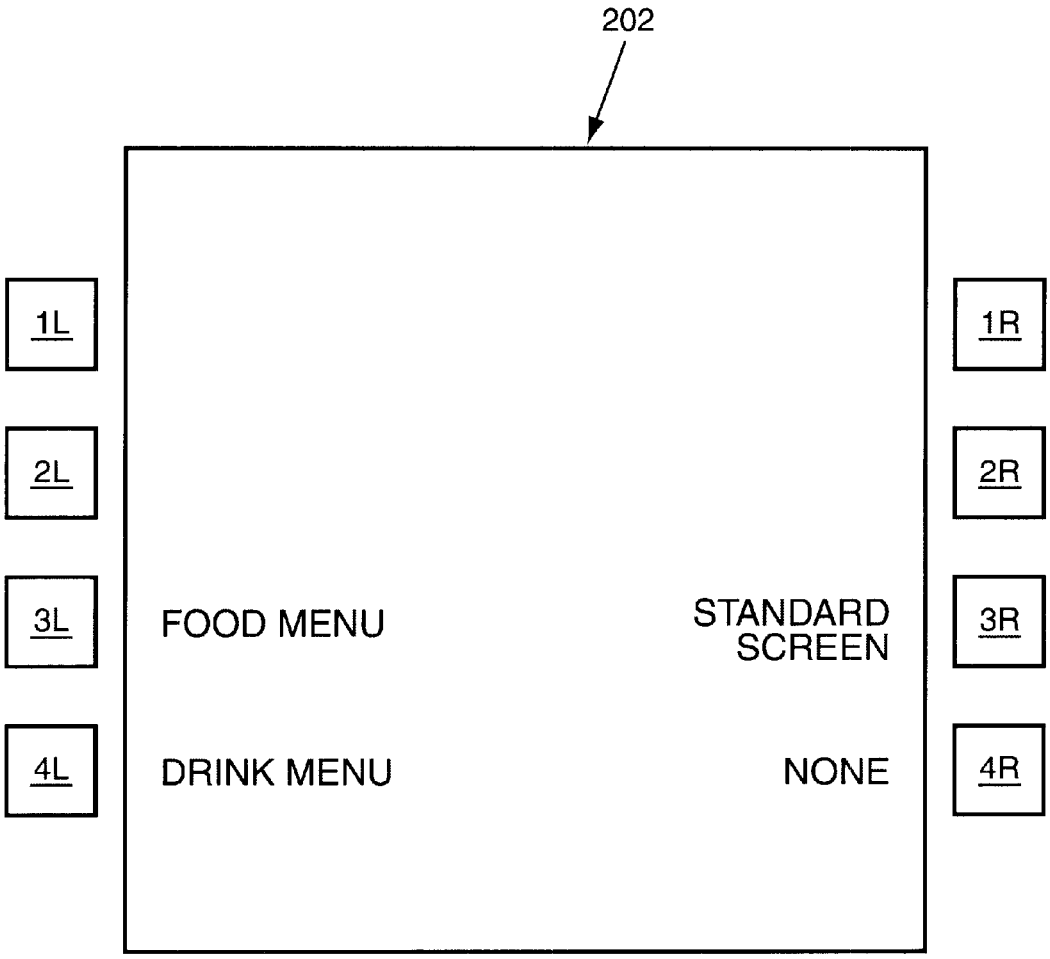
FIG. 14A illustrates a tiered arrangement of the menu options of FIG. 14.
Figure 14B:
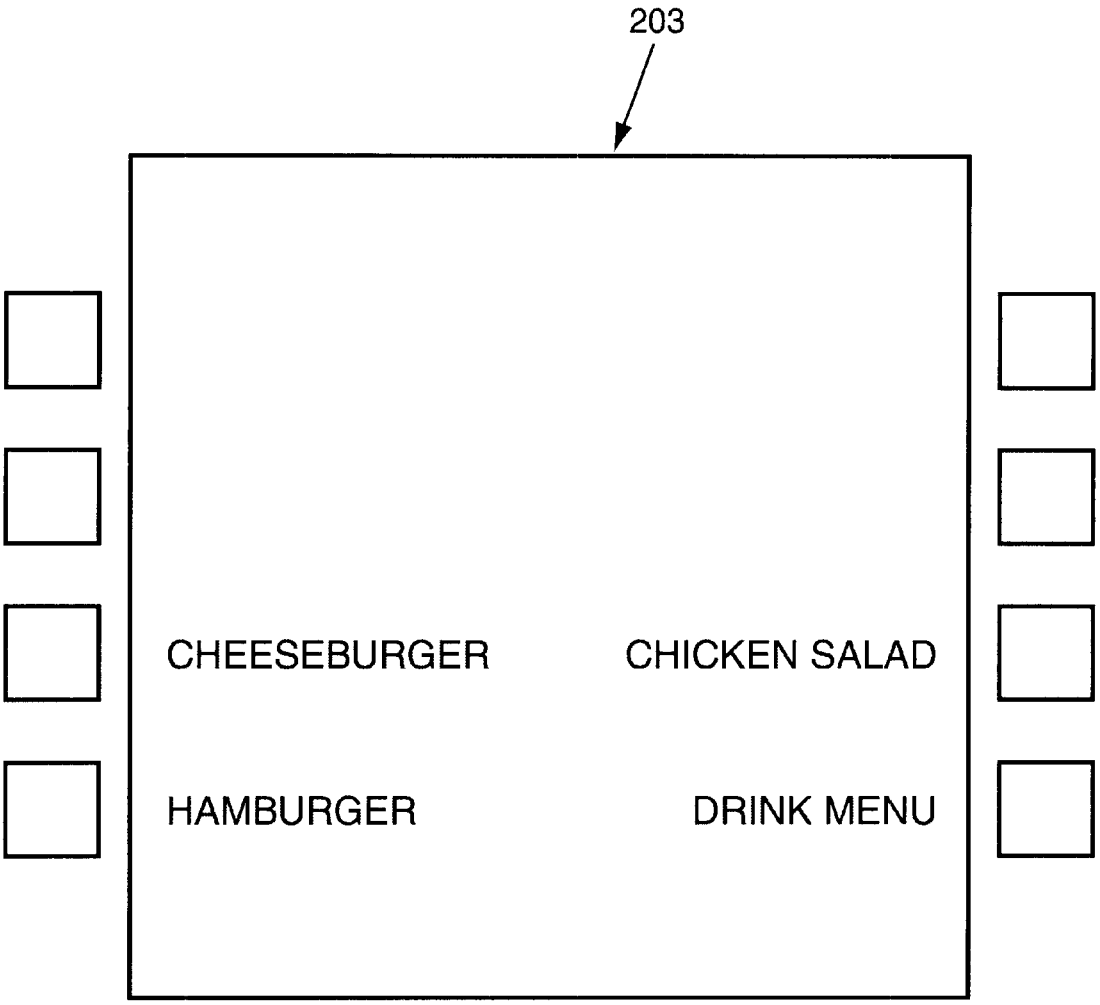
FIG. 14B illustrates a subsequent display screen of the food menu options illustrated in FIG. 14A.

The same tiering arrangement for a soft key display is illustrated in FIGS. 14, 14A, and 14B. The menu options and soft key input devices of FIG. 14 are reconfigured to a generalization in FIG. 14A to insure the menu options are available within the range requirements of the reduced second display 202. FIG. 14A illustrates a partial listing of the menu options, those individual food items available under the "Food Menu" or "Drink Menu", in an orientation allowing them to fit within the handicapped accessible range. One skilled in the art will understand that the present invention includes any number of subsequent tiered screens necessary to include the menu options.

A standard screen option is also included as illustrated in FIG. 14A to return the menu options to those previously displayed in the preceding screen. This option allows for a user who inadvertently pushes a handicapped screen option to return and follow the menu options for a non-handicapped user. By way of example, the user who inputs the handicapped user option from the menu display of FIG. 14 will be shown the menu options of FIG. 14A. If this was inadvertent, the user can press the previous screen option and the display will revert back to that illustrated in FIG. 14.

Figure 15:
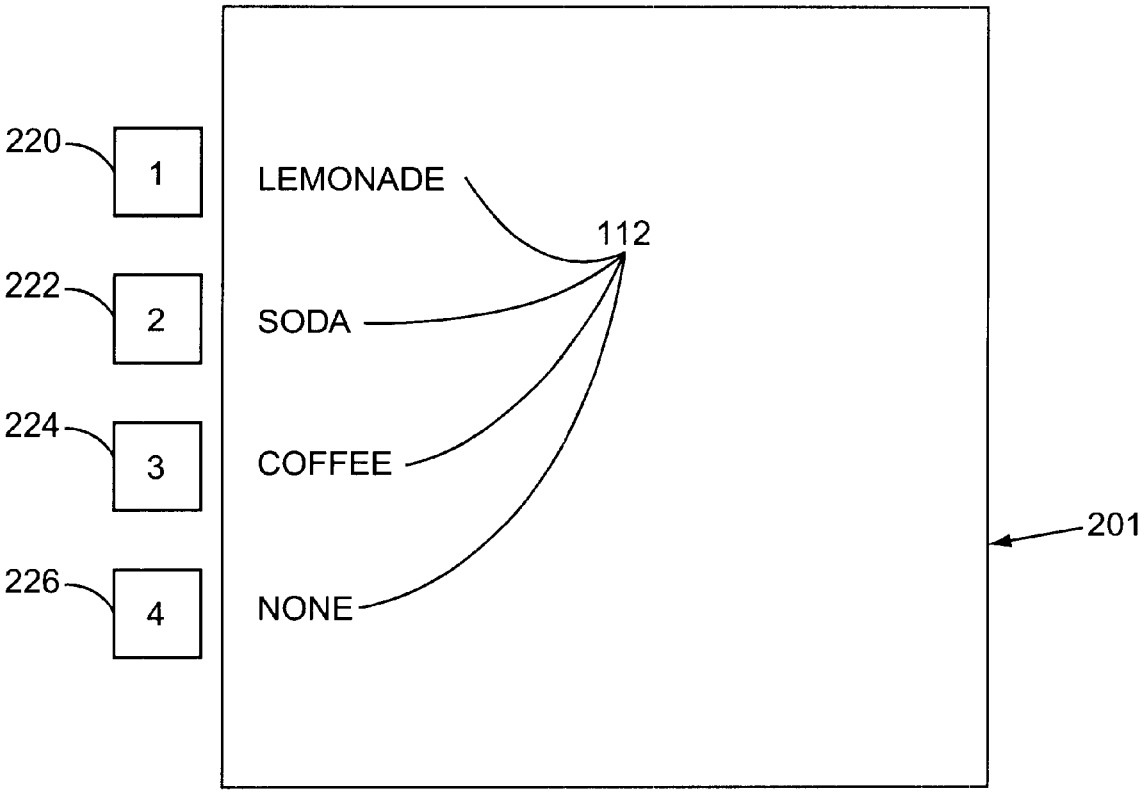
FIG. 15 is a front view of a first display screen having input devices of adjacent soft keys and keypad.
Figure 15:
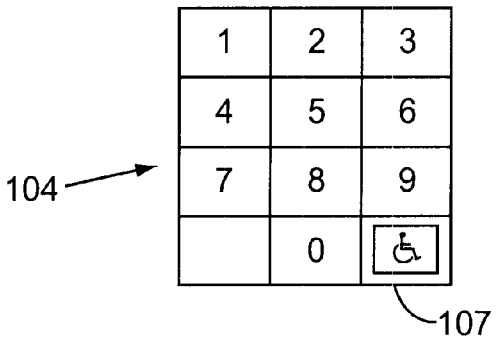

Another embodiment for inputting information is a display and hard key combination illustrated in FIG. 15. The keys of the keypad 104 are linked in parallel functions with the soft keys 220, 222, 224, 226 above. The first display 201 displays the menu options 112 and the dispenser controller 80 assigns the appropriate function to each of the soft keys 220, 222, 224, 226. In the first display 201, the soft keys are the only means for the user to input the menu options to the dispenser controller as the key pad 104 is not active. Upon receipt of a handicap user signal, the dispenser controller reassigns the value of the soft keys to the corresponding key pads 104. By way of example, the function assigned to soft key 220 for selecting "Lemonade" is also assigned to keypad 1, soft key 222 "Soda" is assigned to key pad 2, etc. This embodiment does not result in a different second display as the display and menu options remain in the same orientation. The only change upon receipt of a handicap signal is to reassign the values of the input devices from the soft keys to the key pad. Alternatively, the functions may be automatically assigned without receipt of a signal. One skilled in the art will understand that a similar arrangement of not requiring a separate second display screen arrangement may be utilized for touch screen and soft key applications.

The present invention is also applicable to other types of display embodiments. Any of the positions within the fueling environment illustrated in FIG. 1 such as the car wash device 48 and the automated vending system 28 that require the user to make selections of goods and services are appropriate for the present-invention. The invention also has applicability outside of the fueling environment, such as a kiosk application having an automated teller machine for a bank as illustrated in FIGS. 7 and 7A.

Certain modifications and improvements will occur to those skilled in the art upon a-reading of the foregoing description. It should be understood that all such modifications and improvements have been deleted herein for the sake of conciseness and readability but are properly within the scope of the following claims.

I claim:

1. A fuel dispensing system for displaying menu options and receiving input from a user comprising:

a display for providing a display screen having menu options;

a first input device corresponding to same menu options for the user to input said menu options; and a dispenser controller for controlling said display and receiving input from said first input device, said dispenser controller equipped to receive a signal indicating that the user is handicapped;

said dispenser controller adapted to provide a second input device, corresponding to said menu options, and within handicapped-accessible range in response to said dispenser controller receiving said signal indicating that the user is handicapped.

2. The apparatus of claim 1, wherein said second input device is inactive until receipt of said signal by said dispenser controller.

3. The fuel dispensing system of claim 2, wherein said second input device is a keypad that comprises at least one key corresponding to at least one of said menu options.

4. The apparatus of claim 1, wherein said display and said menu options are maintained the same upon receipt of said signal by said dispenser controller.

5. The apparatus of claim 1, wherein said second input devices are positioned at a height of less than about 48 inches to allow access for disabled persons.

6. The fuel dispensing system of claim 1, wherein said dispenser controller provides said second input device by modifying said first input device.

7. The fuel dispensing system of claim 6, wherein at least one input on said first input device is lowered in height to provide said second input device.

8. A fuel dispenser having an interface accessible to disabled persons, comprising:

a fuel dispenser capable of delivering fuel to a vehicle; and a user interface and control system associated with said fuel dispenser and adapted to display information to a user and receive input from the user, said user interface adapted to provide a first interface configuration for standard operation and a second interface configuration accessible by handicapped user upon receipt of a signal indicating the presence of a handicapped user at said fuel dispenser.

9. The fuel dispenser of claim 8, wherein said user interface includes a display capable of displaying selection indicia to the user and soft keys adjacent said display for receiving input from the user selecting the selection indicia upon actuating one of said soft keys located proximate the selection indicia, said first interface configuration providing said selection indicia in a first position and said second interface configuration providing said selection indicia in a second position adjacent one said soft key, which is accessible to the handicapped user.

10. The fuel dispenser of claim 8, wherein said control system determines the presence of a handicapped user at the dispenser upon the user actuating an input portion of the user interface indicating the user is handicapped.

11. The fuel dispenser of claim 8, wherein said control system is associated with a receiver and determines the presence of a handicapped user at the dispenser upon receiving a signal via the receiver indicating the user is handicapped.

12. The fuel dispenser of claim 11, wherein the signal is one of the group consisting of acoustic, radio frequency, optic, and wireless signals.

13. The fuel dispenser of claim 11, wherein the signal is one of the group consisting of vocal, aural, and mechanically reproduced.

14. The fuel dispenser of claim 11, wherein the control system is further associated with an interrogator including said receiver, said signal is transmitted from a transponder associated with the user or user's vehicle.

15. The fuel dispenser of claim 8, wherein said user interface includes a touch screen display capable of displaying selection indicia to the user and receiving input from the user selecting the selection indicia upon touching the display proximate the selection indicia, said first interface configuration providing said selection indicia in a first position and said second interface configuration providing said selection indicia in a second position, which is accessible to the handicapped user.

16. The fuel dispenser of claim 15, wherein said first interface configuration is compressed to provide said second interface configuration.

17. The fuel dispenser of claim 15, wherein said first interface configuration is reduced to provide said second interface configuration.

18. The fuel dispenser of claim 17, wherein said first interface configuration has the same aspect ratio as said second interface configuration.

19. The fuel dispenser of claim 17, wherein the height of said first interface configuration is reduced to provide said second interface configuration.

20. The fuel dispenser of claim 8, wherein said controls system provides said second interface configuration by modifying said standard interface configuration.

21. The fuel dispenser of claim 20, wherein at least one input on said standard interface configuration is lowered in height to provide said second interface configuration.

22. The fuel dispenser of claim 8, wherein said second interface configuration is a keypad that comprises at least one key corresponding to said display information.

23. A fuel dispenser interface accessible to disabled persons comprising:

a fuel dispenser capable of delivering fuel to a vehicle; and means associated with said fuel dispenser for displaying information to a user and receiving input from the user, said means adapted to provide a first interface configuration for standard operation and a second interface configuration accessible by handicapped user upon receipt of a signal indicating the presence of a handicapped user at said fuel dispenser.

24. The fuel dispenser of claim 23, wherein said means determines the presence of a handicapped user at the dispenser upon the user actuating an input means on said dispenser indicating the user is handicapped.

25. The fuel dispenser of claim 23, wherein said means is associated with a receiver and determines the presence of a handicapped user at the dispenser upon receiving a signal via the receiver indicating the user is handicapped.

26. The fuel dispenser of claim 23, further including a means for said user to change said user interface from said second interface to said first interface.

* * * * *